United States Patent [19]

Bellin

[11] Patent Number: 4,807,764

[45] Date of Patent: Feb. 28, 1989

[54] SYSTEM FOR MOUNTING ARTICLES UNDER A DOWNWARDLY FACING SURFACE

[76] Inventor: Tamara Bellin, 104 Flax Mill Rd., Branford, Conn. 06405

[21] Appl. No.: 90,157

[22] Filed: Aug. 27, 1987

[51] Int. Cl.[4] ..... A47F 5/08

[52] U.S. Cl. ..... 211/94; 211/118

[58] Field of Search ..... 211/94, 162, 74, 113, 211/118; 312/194; 248/201, 287, 675, 317

[56] References Cited

U.S. PATENT DOCUMENTS

| | | | |
|---|---|---|---|
| Re. 18,402 | 3/1932 | Bebb | 211/113 X |
| 1,462,803 | 7/1923 | Deserty | 211/162 X |
| 4,094,415 | 6/1978 | Larson | 211/94 X |
| 4,371,138 | 2/1983 | Roberts | 248/201 |
| 4,600,248 | 7/1986 | Pflieger | 312/195 |
| 4,653,818 | 3/1987 | De Bruyn | 211/113 X |

*Primary Examiner*—Ramon S. Britts
*Assistant Examiner*—Sarah A. Lechok Eley
*Attorney, Agent, or Firm*—Richard A. Craig

[57] ABSTRACT

A system for mounting articles includes a channel-shaped track member attachable to a downwardly facing surface having a central portion, side portions and coplanar bottom portions extending toward each other from the side portions and having confronting free edges. One of the side portions and the bottom portion integral therewith have a plurality of cut-out portions spaced apart such that the distance between any two adjacent cut-out portions is a constant dimension A. A first article holding rack has a pair of vertical arms each with a guide at the top, these guides being shaped, dimensioned and spaced to enter two adjacent ones of the cut-out portions. A second article holding rack has a pair of vertical arms each with a guide at the top, these guides being shaped, dimensioned and spaced to enter two non-adjacent ones of the cut-out portions. An adjustable article holding support unit is provided for articles which are not readily usable with holders dimensioned to conform to multiples of the distance between adjacent cut-out portions of the track member.

8 Claims, 4 Drawing Sheets

FIG. 4
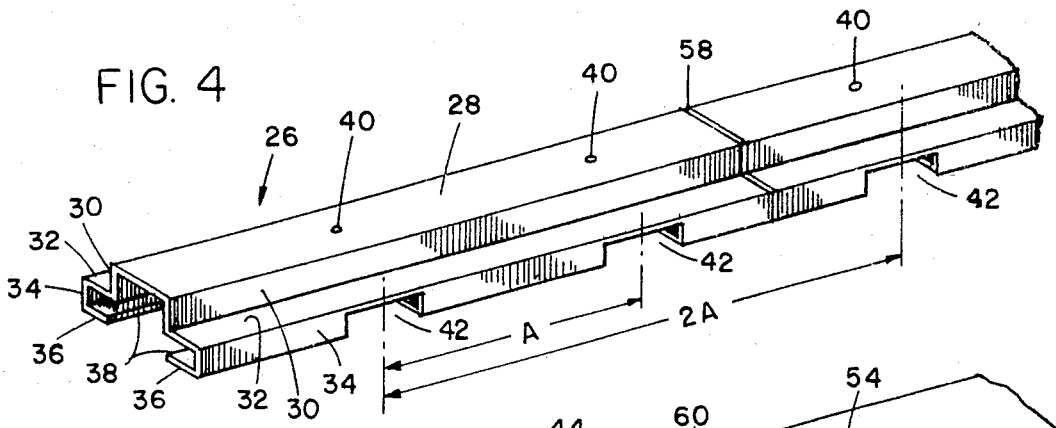
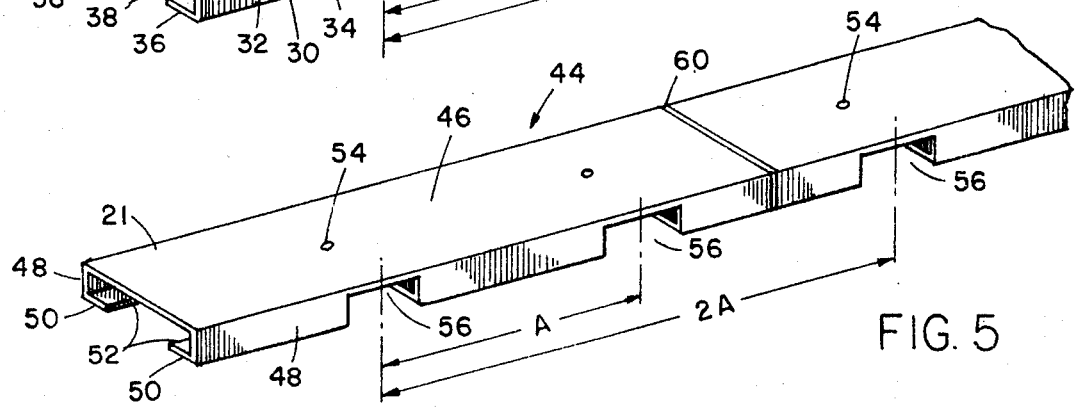
FIG. 5
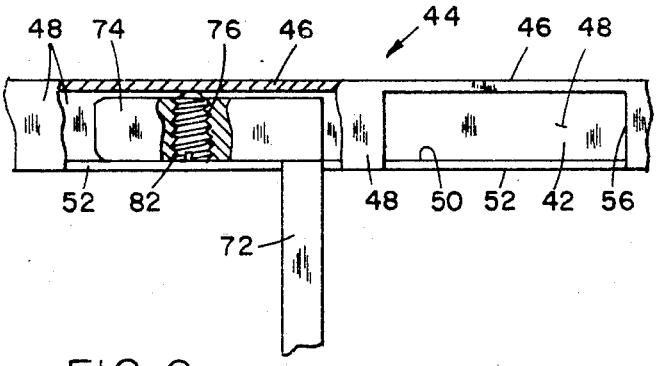
FIG. 6
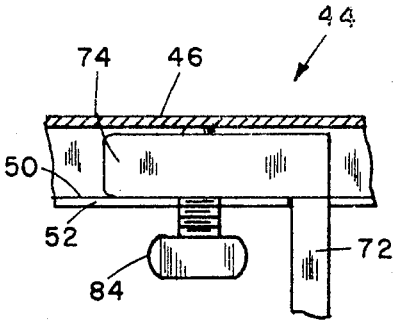
FIG. 7

SYSTEM FOR MOUNTING ARTICLES UNDER A DOWNWARDLY FACING SURFACE

BACKGROUND OF THE INVENTION

The present invention relates to a system for mounting articles under a downwardly facing surface, such as that provided by a kitchen cabinet, the under surface of a stair tread, a shelf or even a ceiling.

It is an important object of the invention to provide such a system which is very simple in construction and easy to use, and which is usable where the articles to be mounted are light or heavy in weight.

It is another object to provide such a system incorporating a track member of particular configuration and an article holding rack of particular configuration for easy assembly and clamping interengagement with the track member.

It is a further object to provide such a system in which the track member has uniformly spaced cut-out portions to receive article holding racks of various dimensions.

The following prior U.S. patents are believed to be typical of the state-of-the-art, but are not thought revelant to the present invention:

| U.S. Pat. No. | Date | Inventor(s) |
|---|---|---|
| 2,557,801 | June 19, 1951 | Shapiro |
| 3,819,058 | June 25, 1974 | Reis |
| 4,209,098 | June 24, 1980 | Adams |
| 4,300,692 | November 17, 1981 | Moreno |
| 4,467,925 | August 28, 1984 | Ratzloff et al. |

SUMMARY OF THE INVENTION

The inventive system for mounting articles comprises a channel-shaped track member attachable to a downwardly facing surface and having a central portion, side portions and coplanar bottom portions extending toward each other from the lower edges of the side portions and having confronting free edges. One of the side portions and that bottom portion which is integral therewith have a plurality of like cut-out portions spaced apart such that the distance between corresponding parts of any two adjacent ones of the cut-out portions is a constant dimension A. A first article holding rack, such as a paper napkin holder, has a pair of vertical arms each with a guide at the top. The guides of the first article holding rack are shaped, dimensioned and spaced to enter two adjacent ones of the cut-out portions, and a second article holding rack, such as a paper towel holder, has a pair of vertical arms each with a guide at the top. The guides of the second article holding rack are shaped, dimensioned and spaced to enter two non-adjacent ones of the cut-out portions. A "double track member device" may be provided comprising two track members as described above held in parallel spaced apart relationship by rigid spacers, and an adjustable article holding support unit may be provided for articles which are not readily usable with holders dimensioned to conform to multiples of the distance between adjacent cut-out portions of the track member.

The foregoing and other objects and advantages will appear hereinafter.

DESCRIPTION OF THE DRAWING

FIG. 4 is a perspective fragmentary view of a track member which is a component of the system;

FIG. 5 is a view similar to FIG. 4 but showing a modified track member which is a component of the system;

FIG. 6 is an enlarged view of the track member of FIG. 5, partly broken away, and showing also an article holding rack secured thereto by a set screw;

FIG. 7 is a view similar to FIG. 6 but showing an article holding rack secured to the track by a thumb screw;

DESCRIPTION OF THE INVENTION

Figure 1:
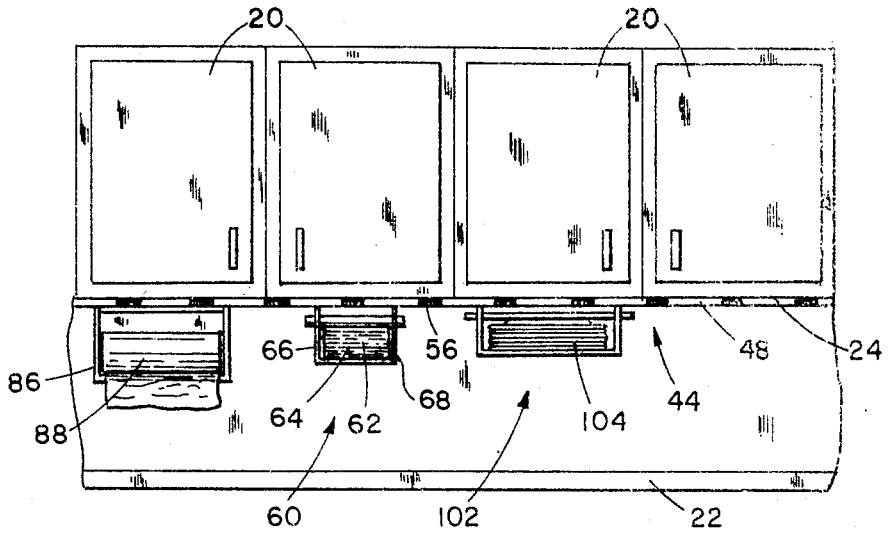
FIG. 1 is a partly fragmentary front elevation showing a set of cabinets vertically spaced above a counter top, with an article mounting system embodying the invention secured underneath the cabinets.

FIG. 1 shows in front elevation a set of kitchen cabinets 20 spaced above a counter top 22. Cabinets 20 have a downwardly facing bottom surface 24 confronting counter top 22. FIG. 1 also shows a system for mounting articles beneath cabinets 20, more particularly in fixed relationship to surface 24, above counter top 22.

The mounting system is not limited to use with cabinets but is equally applicable to any downwardly facing surface, such, for example, as the bottom surface of a shelf or a stair tread or even a ceiling. The mounting system comprises a channel-like track member device and means for holding articles and for releasably engaging the track member device. The track member device can be formed from an extrusion of suitable material, such as aluminum or polyvinyl chloride (PVC), of substantially uniform wall thickness and of a shape that is symmetrical with respect to a central longitudinal plane.

One such track member device is track member 26, shown in FIG. 4, which is of particular utility where bottom surface 24 has a plane peripheral portion and a recessed central portion parallel to and above the plane peripheral portion. Member 26 has a rectangular raised central portion 28 and like spaced parallel side portions 30 depending perpendicularly from opposite sides of portion 28. Like coplanar rectangular portions 32 extend outwardly from the lower edges of portions 30, like dimensioned parallel rectangular side portions 34 depend perpendicularly from the outer side edges of portions 32, and like dimensioned rectangular coplanar bottom portions 36 extend toward each other from the lower edges of side portions 34. Bottom portions 36 terminate in confronting parallel free edges or lips 38 spaced a predetermined distance from each other. Raised central portion 28 is provided with spaced mounting holes 40 therethrough, in the central longitudinal plane of track member 26.

One side portion 34 of track member 26 and that bottom portion 36 which is integral therewith are provided with a plurality of spaced parallel-sided cut-out portions 42. The distance between corresponding parts of any two adjacent cut-out portions 52 is a constant dimension A, whereby the distance between corresponding parts of every second adjacent pairs of cut-out portions 42 is 2A.

Track member 26 can be affixed by mounting screws (not shown) passing through mounting holes 40 and screwed into the recessed central portion of surface 24, with cut-out portions 42 exposed below the peripheral portion of surface 24.

A second such track member is track member 44, shown in FIGS. 5–10, which is of particular utility where the bottom, downwardly facing surface 24 of cabinets 20 is not recessed, but lies all in the same plane. Member 44 has a rectangular central portion 46 and like dimensioned parallel side portions 48 depending perpendicularly from opposite sides of portion 46. Like dimensioned rectangular coplanar bottom portions 50 extend toward each other from the lower edges of side portions 48. Bottom portions 50 terminate in confronting parallel free edges or lips 52 spaced a predetermined distance from each other. Central portion 46 is provided with spaced mounting holes 54 therethrough, in the central longitudinal plane of track member 44.

One such side portion 48 of track member 44 and that bottom portion 50 which is integral therewith are provided with a plurality of spaced parallel-sided cut-out portions 56. The distance between corresponding parts of any two adjacent cut-out portions 56 is constant dimension A, whereby the distance between corresponding parts of every second pair of cut-out portions 56 is 2A.

Track member 44 can be affixed by mounting screws (not shown) passing through mounting holes 54 and screwed into surface 24, with cut-out portions 56 exposed.

The only difference between track members 26 and 44 is that track member 26 has raised central portion 28 and parallel side portions 30 which are lacking in track member 44, whereby the vertical distance between mounting holes 40 and cut-out portions 42 is greater than the vertical distance between mounting holes 54 and cut-out portions 56.

Track members 26 and 44 may be provided with score lines 58 and 60, respectively, at which members 26 and 44 can be snapped off or otherwise cut to desired length.

FIG. 1 would be the same whether or not surface 24 is all in the same plane. It is assumed that surface 24 is all in the same lane. Thus, the track member is designated track member 44 in FIG. 1.

The mounting system further comprises one or more article holding racks which are readily brought into assembly with either track member 26 or track member 44 after that track member is put into assembled relationship with a downwardly facing surface, such as downwardly facing surface 24.

Figure 2:
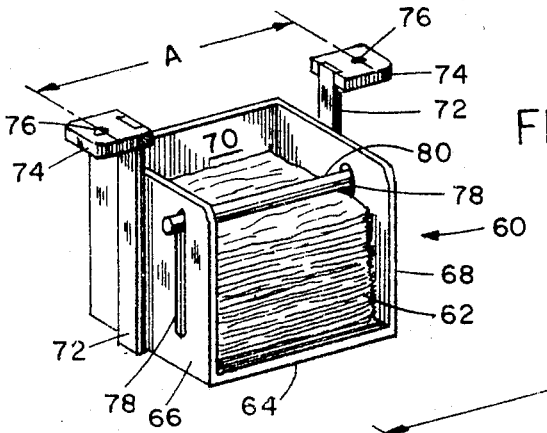
FIG. 2 is a perspective view of a first article holding rack in the form of a napkin holder which is a component of the system.
Figure 10:
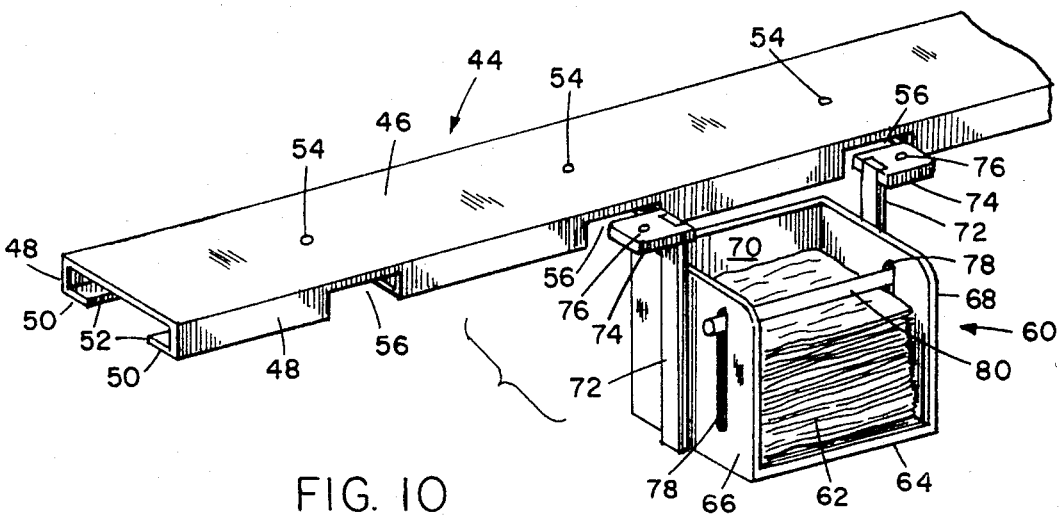
FIG. 10 is a view showing the holder as shown in FIG. 2 and the modified track member as shown in FIG. 5, the holder in position for assembly with the track member.

FIG. 1 shows an article holding rack 60, which is also shown enlarged in FIGS. 2 and 10. Rack 60 is a paper napkin holder and is shown with a stack of napkins 62 therein. Rack 60 has a bottom 64, parallel left and right sides 66 and 68, respectively, and a rear side 70, sides 66, 68 and 70 being perpendicular to bottom 64, and rear side 70 being perpendicular to sides 66 and 68. Rack 60 also has, affixed to sides 66 and 68, a pair of parallel vertical arms 72 extending above sides 66 and 68. Coplanar generally rectangular sliders or guides 74 are affixed to the upper ends of arms 72 and extend away from each other and have tapped holes 76 therethrough. Sides 66 and 68 have aligned vertical slots 78 to accommodate the ends of a napkin hold down bar 80 which rests on the stack of napkins 62.

Tapped holes 76 are spaced apart a distance which is equal to a whole number multiplied by dimension A. As illustrated, the whole number is unity, whereby the distance between tapped holes 76 of rack 60 is A. Guides 74 are dimensioned to enter cut-out portions 42 or 56. The thickness of guides 74 is less than the vertical distance between portion 32 and 36 of track member 26 and the vertical distance between portions 46 and 50 of track member 44, while the width of guides 74 is greater than the distance between free edges or lips 38 of track member 26 and the distance between free edges or lips 52 of track member 44.

Thus, in result, rack 60 is readily brought into assembled relationship with either track member 26 or track member 44 by passing guides 74 into adjacent cut-out portions 42 or 56, sliding rack 60 lengthwise of member 26 or 44, either left or right, until guides 74 are not in registry with cut-out portions 42 or 56 and then tightening set screws 82 (FIG. 6) or thumb screws 84 (FIG. 7) in tapped holes 76 against either central portion 28 of member 26 or central portion 46 of member 44.

Figure 3:
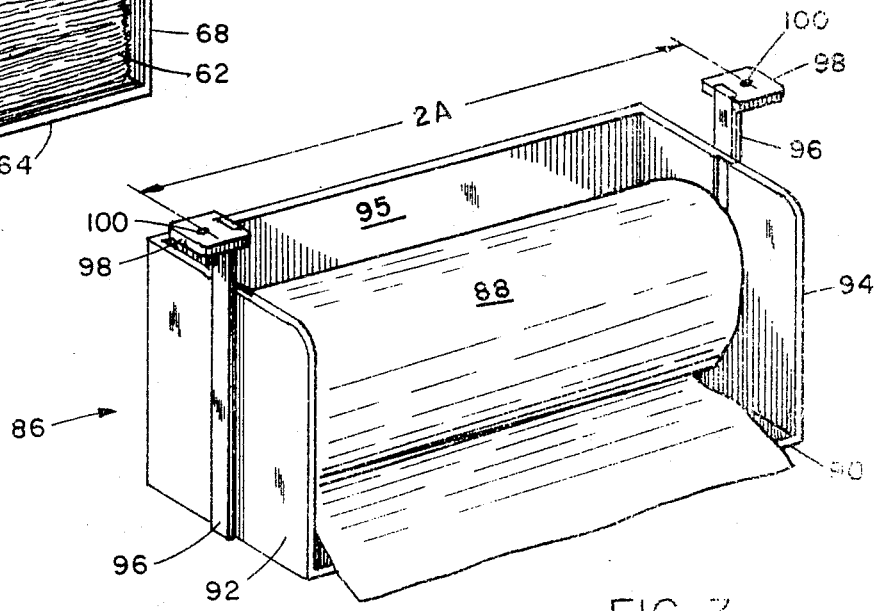
FIG. 3 is a perspective view of a second article holding rack in the form of a paper towel holder which is a component of the system.
Figure 8:
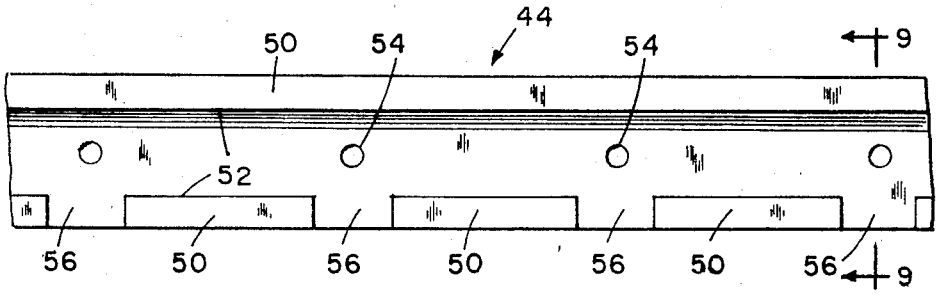
FIG. 8 is a bottom view of the track member of FIG. 5.
Figure 9:
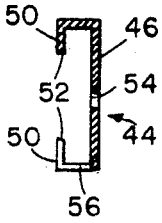
FIG. 9 is a view on line 9—9 of FIG. 8.

FIG. 1 further shows an article holding rack 86, which is also shown enlarged in FIG. 3. Rack 86 is a paper towel holder and is shown with a roll of paper towels 88 therein. Rack 86 is similar to rack 60, having a bottom 90, sides 92 and 94 and a rear side 95. Affixed to sides 92 and 94 are parallel vertical arms 96 extending above sides 92 and 94, sliders or guides 98 being affixed to the upper ends of arms 96 and extending away from each other and having tapped holes 100 therethrough. Arms 96, guides 98 and holes 100 may be, and as shown are, the same as arms 72, guides 74 and holes 76 of rack 60.

Tapped holes 100 are spaced apart a distance which is equal to a whole number multiplied by dimension A. As illustrated, the whole number is 2, whereby the distance between tapped holes 100 of rack 86 is 2A. Rack 86 is easily brought into assembled relationship with track member 26 or track member 44 in the same manner as is rack 60, except that in the case of rack 86, guides 98 are passed into a pair of cut-out portions 42 or 56 which are spaced apart distance 2 A.

FIG. 1 also shows an article holding rack 102 which is a paper plate holder and is shown with a stack of paper plates 104 therein. Otherwise, rack 102 is the same as rack 86.

Figure 11:
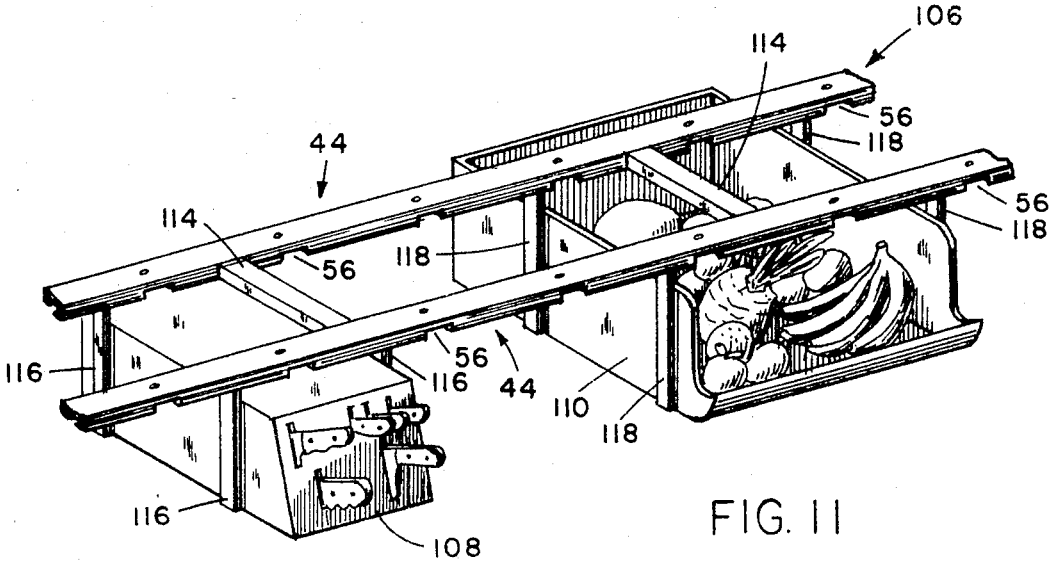
FIG. 11 is a perspective view of a modification of the inventive system, showing a modified track member device, particularly suited for handling article holders for heavier articles.

FIG. 11 shows a modified track member device 106 which is suited to handling heavier articles, such as a knife rack 108 of width A or a vegetable bin 110 of width 2A. Track member device 106 utilizes a pair of parallel track members 44 rigidly joined by spacers 114, with cut-out portions 56 of the two members 44 aligned. Rack 108 has on each side two vertical arms 116 spaced apart the distance between track members 44. Likewise, bin 112 has on each side two vertical arms 118. The tops of arms 116 and 118 have sliders or guides (not shown) which are the same as sliders or guides 74 or 98. Track member device 106 is sometimes hereinafter termed for convenience "a double track member device".

Figure 12:
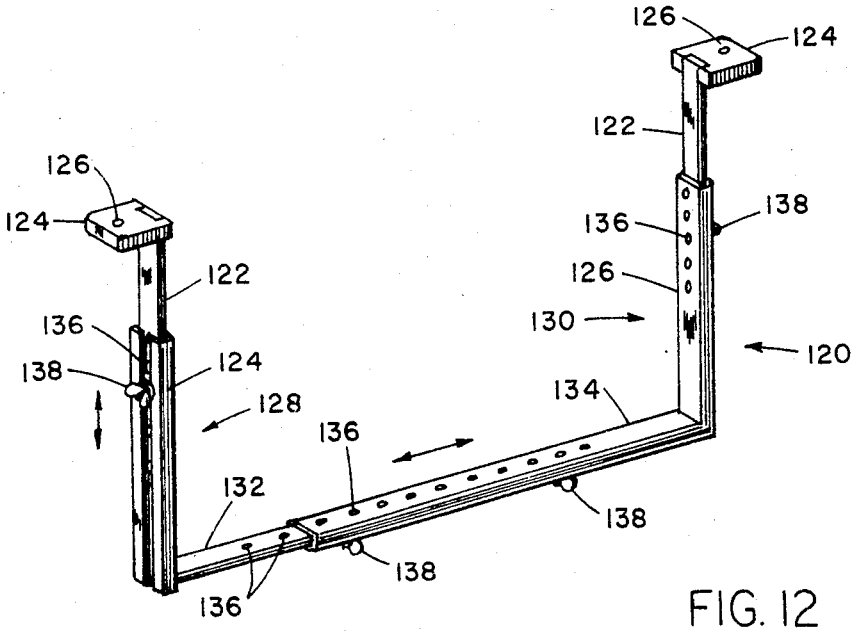
FIG. 12 is a perspective view of an adjustable support unit for use particularly in mounting an odd size item to a track member embodying the invention.
Figure 13:
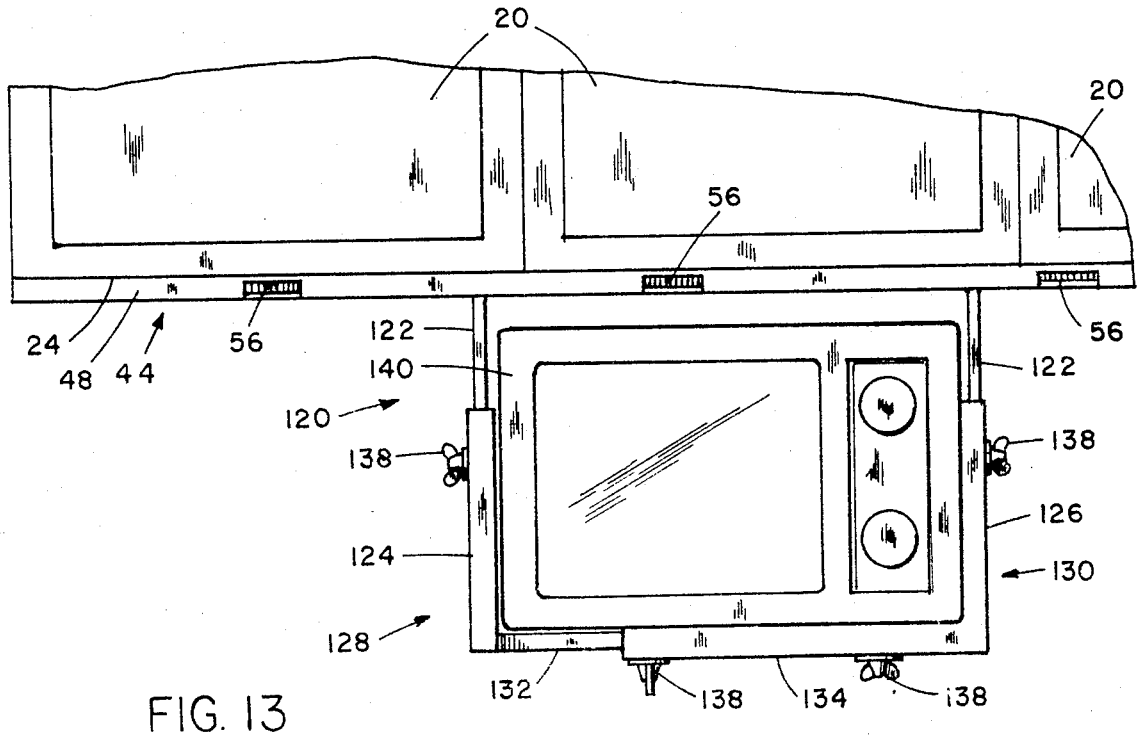
FIG. 13 is a partly fragmentary front elevation showing the adjustable support unit of FIG. 12 used to mount an odd size item to the further modified form of track member of FIG. 11.

FIGS. 12 and 13 show an adaptation of the inventive system to accommodate articles which are not readily usable with holders dimensioned to conform to multiples of the distance between adjacent cut-out portions of a track member, particularly a double track member device as shown in FIG. 11.

FIG. 12 shows an adjustable article holding support unit 120 having a pair of vertical arms 122 each having a slider or guide 124 at its top, with a tapped hole 126 therethrough. Arms 122 telescopically engage vertical portions 124 and 126 of right-angle members 128 and 130, respectively. Members 128 and 130 have horizontal portions 132 and 134, respectively, which telescopically engage each other. Arms 122 and members 128 and 130 are provided with apertures as indicated at 136 at spaced locations along the length thereof, whereby the distance between arms 122 can be varied and the height of guides 124 can be varied and the parts set and clamped in the desired relative positions by thumb screws 138.

FIG. 13 shows track member 44, being the front track member of a double track member device according to FIG. 11, mounted beneath downwardly facing surface 24 as described previously. FIG. 13 also shows a relatively heavy article, such as a TV 140, secured to track member 44 by means of two adjustable support units 120, only the front one of which, i.e., the one associated with front track member 44, is visible. The width of TV 140 is not related very closely to dimension A or any plural multiple thereof, but support units 120 are nevertheless easily assembled with track members 44 to hold TV 140. Guides 124 are inserted in any cut-out portion 56 and horizontal portions 132 and 134 are brought into telescopic engagement, with arms 122 in telescopic engagement with vertical portions 124 and 126. Arms 122 are placed a distance apart sufficient to receive TV 140 therebetween and horizontal portions 132 and 134 are clamped together by screws 132. Guides 124 are secured to track member 44 as aforesaid, and arms 122 are adjusted to proper length and clamped in position by screws 138, according to the height of TV 140. This operation is repeated for the invisible track member 44 and the invisible support unit 120. Finally, TV 140 is placed in the rack so formed by support units 120.

It is evident that the invention achieves the objects and advantages set forth above and others.

The disclosed details are exemplary only and are not to be taken as limitations on the invention except as those details may be included in the appended claims.

What is claimed is:

1. A system for mounting articles, said system comprising a unitary channel-shaped track member attachable to a fixed downwardly facing surface, said track member having a central portion, parallel side portions and coplanar bottom portions extending toward each other from the lower edges of said side portions and having parallel confronting free edges, one of said side portions and that said bottom portion which extends therefrom having at least three like cut-out portions spaced apart such that the distance between corresponding parts of any two adjacent ones of said cut-out portions is a constant dimension A, and an adjustable article holding support unit having a pair of vertical arms each having at its top a guide shaped and dimensioned for entry into a said cut-out portion, and a pair of right-angle members having horizontal portions telescopically engageable with each other and vertical portions telescopically engageable with said arms, whereby the distance between said arms is adjustable and the length of said arms is adjustable.

2. A system according to claim 1 wherein said article holding racks are slidable lengthwise of said track member after said guides have entered said cut-out portions and said system further comprises means for immobilizing said racks with said guides out of registry with said cut-out portions.

3. A system according to claim 2 wherein said guides have tapped holes therethrough and screws are engageable with said tapped holes and rotatable therein into clamping engagement with said central portion of said track member.

4. A system according to claim 1 wherein said track member is provided with a plurality of mounting holes through said central portion for receiving fastening devices to mount said track member to said downwardly facing surface.

5. A system according to claim 1 wherein said track member is a first track member and said system further comprises a second track member the same as said first track member and rigid spacers holding said first and second track members in parallel relationship.

6. A system according to claim 5 wherein said cut-out portions of said first and second track members are aligned with each other.

7. A system according to claim 1 wherein said arms and said right-angle members are provided with apertures at spaced locations along the length thereof, so that said arms and said right-angle members can be clamped in desired position by screws engaging selected ones of said apertures.

8. A system according to claim 1 wherein said track member is a first track member and said system further comprises a second track member the same as said first track member, rigid spacers holding said first and second track members in parallel relationship, and said adjustable article holding support unit is a first article holding support unit for assembly with said first track member and said system further comprises a second article holding support unit the same as said first article holding support unit for assembly with said second track member.

* * * * *